US010316524B2

(12) United States Patent
Heidtmann

(10) Patent No.: US 10,316,524 B2
(45) Date of Patent: Jun. 11, 2019

(54) RAIL SYSTEM

(71) Applicant: KOMPROMENT HOLDING AF 2007 APS, Svenstrup (DK)

(72) Inventor: Niels Heidtmann, Kolding (DK)

(73) Assignee: Kompromenf Holding af 2007 ApS, Svenstrup, Denmark (DK)

( * ) Notice: Subject to any disclaimer, the term of this patent is extended or adjusted under 35 U.S.C. 154(b) by 0 days.

(21) Appl. No.: 15/572,425

(22) PCT Filed: May 18, 2016

(86) PCT No.: PCT/DK2016/050134
§ 371 (c)(1),
(2) Date: Nov. 7, 2017

(87) PCT Pub. No.: WO2016/184473
PCT Pub. Date: Nov. 24, 2016

(65) Prior Publication Data

US 2018/0171640 A1 Jun. 21, 2018

(30) Foreign Application Priority Data

May 21, 2015 (DK) ..... 2015 70303

(51) Int. Cl.
*E04F 13/08* (2006.01)
*E04D 1/34* (2006.01)

(52) U.S. Cl.
CPC ..... *E04F 13/0828* (2013.01); *E04D 1/34* (2013.01); *E04F 13/0803* (2013.01);
(Continued)

(58) Field of Classification Search
CPC . E04F 13/081; E04F 13/0828; E04F 13/0803; E04F 13/0864; E04D 1/34; E04D 2001/3438; E04D 2001/3414
See application file for complete search history.

(56) References Cited

U.S. PATENT DOCUMENTS 4,607,471 A * 8/1986 Olsen ..... E04F 13/0803 52/509
5,517,795 A * 5/1996 Doke ..... A47B 96/1416 248/243

(Continued)

FOREIGN PATENT DOCUMENTS

AT 505493 A1 * 1/2009 ..... E04F 13/0808
CH 659679 A5 2/1987

(Continued)

OTHER PUBLICATIONS

International Search Report for Application No. PCT/DK2016/050134, dated Jul. 4, 2016.
Supplementary European Search Report for Application No. EP 16795925, dated Dec. 11, 2018.

*Primary Examiner* — Babajide A Demuren
(74) *Attorney, Agent, or Firm* — Marshall, Gerstein & Borun LLP

(57) ABSTRACT

The invention concerns a rail system for mounting facing elements on a facade, wherein the rail system includes an elongated rail with a longitudinal direction, the rail including means for direct or indirect mounting on a façade, the rail further including means for fixing facing elements to the rail, and wherein the rail system further includes at least one fixing unit for each facing element, the means for direct or indirect mounting on a facade being constituted by at least one flange member, and wherein the means for fixing facing elements to the rail includes a body part with a contact face for a back side of a facing element. The new feature of a rail system according to the invention is that the body part includes at least a first set of fixing means and at least a second set of fixing means, each set of fixing means being adapted to an individual type of fixing units. In a rail according to the invention there is thus provided at last two different types of fixing means.

12 Claims, 7 Drawing Sheets

(52) U.S. Cl.
CPC .. *E04F 13/0864* (2013.01); *E04D 2001/3414* (2013.01); *E04D 2001/3438* (2013.01); *E04F 13/081* (2013.01)

(56) References Cited

U.S. PATENT DOCUMENTS

| | | | | | |
|---|---|---|---|---|---|
| 5,522,193 | A * | 6/1996 | Sommerstein | E04F 13/081 52/235 |
| 6,460,311 | B1 | 10/2002 | Ito | |
| 8,191,327 | B2 * | 6/2012 | Griffiths | E04F 13/0825 24/457 |
| 2007/0261348 | A1 | 11/2007 | Surowiecki | |
| 2014/0119815 | A1 | 5/2014 | Brady | |
| 2014/0260042 | A1 * | 9/2014 | Todd | E04F 13/0805 52/489.1 |
| 2017/0226747 | A1 * | 8/2017 | Fernandez Fernandez | E04F 13/0805 |

FOREIGN PATENT DOCUMENTS

| | | | | | |
|---|---|---|---|---|---|
| CN | 203441049 | U | | 2/2014 | |
| DE | 8130814 | U1 | | 3/1982 | |
| DE | 3203467 | A1 | | 8/1983 | |
| DE | 10205623 | A1 | | 9/2003 | |
| EP | 0167032 | A2 | | 1/1986 | |
| EP | 0271400 | A1 | | 6/1988 | |
| EP | 0409720 | A1 | | 1/1991 | |
| EP | 1426521 | A2 | | 6/2004 | |
| EP | 1990479 | A1 | * | 11/2008 | E04F 13/081 |
| EP | 3020884 | A1 | * | 5/2016 | E04F 13/081 |
| JP | H11117500 | A | | 4/1999 | |
| JP | 2013124488 | A | | 6/2013 | |
| WO | WO-2016166395 | A1 | * | 10/2016 | E04F 13/081 |

* cited by examiner

RAIL SYSTEM

CROSS-REFERENCE TO RELATED APPLICATION

The present application is the US national phase of International Application No. PCT/DK2016/050134, filed May 18, 2016, which claims priority to Denmark Application No. PA201570303, filed May 21, 2015. The priority application, DK PA201570303, is hereby incorporated by reference.

FIELD OF THE INVENTION

The present invention concerns a rail system for mounting facing elements on a facade, wherein the rail system includes an elongated rail with a longitudinal direction, the rail including means for direct or indirect mounting on a façade, the rail further including means for fixing facing elements to the rail, and wherein the rail system further includes at least one fixing unit for each facing element, the means for direct or indirect mounting on a facade being constituted by at least one flange member, the flange member extending in a first plane, and wherein the means for fixing facing elements to the rail includes a body part with a contact face for a back side of a facing element, wherein the contact face extends in a second plane, the first and second plane being disposed mutually offset.

DESCRIPTION OF PRIOR ART

In connection with covering facades of buildings it is known to mount rail systems at the façade and then mount facing elements on the rail system. The facing elements can be of many different kinds, including tile or slate plates of suitable size that are mounted by clips on the applied rail system.

Such a facade system is known i.a. from the patent publication CH 659 679 A5 that discloses a solution wherein a rather complex rail system is fitted with clips holding the facing elements against horizontal rails. As already mentioned, this is a rather complex system made up of extruded aluminium profiles that are fixed on special fittings mounted in beforehand on a different type of rails which are mounted vertically and suitably spaced apart on a wall. This system comprises a lot of loose parts that are to be mounted and aligned in relation to each other. Moreover, the disposition of the hooks by which the facing elements are fixed is not controlled in horizontal direction. This means that the facing elements can be fixed, but the hooks, one end of which being visible after mounting, are more or less randomly located. It is an expressed wish that these visible hook ends are at least arranged in a given pattern and that this can be provided without substantial work associated therewith. By this system, the hooks can only be arranged as desired by a manual effort with aligning rail or similar, which is unwanted.

The German publication DE 102 05 623 A1 discloses a different solution with rails for mounting facing elements. Here also is used a complex system of vertical and horizontal rails that are joined by numerous parts and which by special clips hold respective facing elements. By this solution, the clips are not visible, why the mutual disposition of the clips is without significance, but this system is only adapted for fixing a certain type of facing elements provided with a key at one edge and an overlapping rabbet at another edge. At the same time, no spring action is incorporated in the clip, meaning that allowance cannot be made for production tolerances that the facing elements inevitably will have in the case of facing elements of tile, natural slate or other types of natural materials normally used for facing.

Both of the above mentioned solutions are rather complex rail systems made of extruded aluminium and adapted only for use with a certain type of clips for a certain method of fastening the facing elements. By the prior art there is therefore a need for individual rails or rail systems with clips for each type of facing elements, meaning that the operating entrepreneurs or makers of such rail systems are to keep several kinds of rails in stock in order to maintain a necessary and desired flexibility for the customers.

US 2014/119815 A1 discloses a rail system for mounting a plate grating on a facade. The rail system includes an elongated rail with a longitudinal direction where the rail includes means for direct mounting on a facade and further includes means for fixing the plate grating to the rail. The rail system further includes at least one fixing unit for each plate grating. The said means for direct mounting on the facade is constituted by at least one flange member, where the flange member extends in a first plane. The means for fixing the plate grating to the rail include a body part with a contact face intended for a back side of the plate grating, where this contact face extends in a second plane, the first and second planes being mutually offset. The body part includes a first and a second set of fixing means. By this solution, however, there is not provided a system enabling use of individual types of fixing units.

OBJECT OF THE INVENTION

It is an object of the invention to indicate a rail system with clips for mounting facing elements, including facing elements of tile and natural slate and of other suitable materials, where the rail system is simple to produce and not the least simple to mount. It is also an object of the invention to indicate a rail system with clips for mounting roof elements.

At the same time, it is an object of the invention to indicate a rail system with clips where the facing elements are mounted securely, and where the rail system with clips allows application of various types of facing elements with certain tolerances on the thickness.

Furthermore, it is an object to indicate a rail system that comprises means for other fastening elements than the above mentioned clips as the rail system can be applied to various types of facing, where one type is mounted by clips and another type is mounted by screws or by another type of clips. In other words, it is also the purpose to indicate a rail system that can be used for different types of facades and for different types of fastening means/fixing units.

Finally, it is an object to indicate a type of fixing units that enable a kind of pre-fabrication, where several facing elements are joined by a joining rail into one facing element that subsequently is mounted as one facing element.

DESCRIPTION OF THE INVENTION

As mentioned above, the invention concerns a rail system for mounting facing elements on a facade, wherein the rail system includes an elongated rail with a longitudinal direction, the rail including means for direct or indirect mounting on a façade, the rail further including means for fixing facing elements to the rail, and wherein the rail system further includes at least one fixing unit for each facing element, the means for direct or indirect mounting on a facade being constituted by at least one flange member, the flange member extending in a first plane, and wherein the means for fixing facing elements to the rail includes a body part with a contact face for a back side of a facing element, wherein the contact face extends in a second plane, the first and second plane being disposed mutually offset.

That the first and second planes are mutually offset is to be understood so that they can be disposed in parallel as well as angled in relation to each other, and so that the respective planes are not coinciding.

It is to be understood that an elongated rail according to the invention as mentioned includes means for direct or indirect mounting on a façade. It may thus be mounting directly on a facade of e.g. wood or brick on which e.g. a new external facing is to be established. Alternatively, a rail system according to the invention can be mounted transversely of other rails or on fittings on a façade such that spacing is provided between the previous facade and the new façade. Hereby is achieved e.g. possibility of providing external insulation of a building and covering the insulation behind a new facing mounted on a rail system according to the invention.

A facade is here to be understood as the exterior of a building, and it may therefore be a vertical wall of a facade as well as an arbitrary inclination of a roof. Therefore it may also be a direct or indirect mounting on a facade for establishing a new external facing that includes a number of facing elements as well as it may be direct or indirect mounting on a roof for establishing a new external roofing, where the roofing therefore can include a number of roofing elements.

The new feature of a rail system according to the invention is that the body part includes at least a first set of fixing means and at least a second set of fixing means, each set of fixing means being adapted to an individual type of fixing units.

In a rail according to the invention there is thus provided at least two different types of fixing means. These fixing means may e.g. be constituted by a series of holes—circular, oval or maybe edged, a series of cutouts, a longitudinal slot or other with which the specific fixing units can interact. On a rail according to the invention there is always at least two kinds of fixing means, but in principle there may well be more than two sets of fixing means on a rail.

The fixing units can be screws or clips but may also be a joining rail that holds several small facing elements so that they appear as a single assembled facing element. By such a rail system is achieved possibility of using the same rail for various types of facing elements, and thereby for various types of fixing units. The rails may be termed universal rails or multi-rails as they can be used for several types of facing elements with each their type of fixing units. The need for storage is hereby reduced, and moreover is achieved possibility of using different types of facing elements on the same façade as the rail system is the same for respective facing elements in spite of the different fastening methods.

In an embodiment, the rail according to the invention may include a body part with at least one contact face for a back side of a facing element, the body part including at last a first set of fixing means and at least a second set of fixing means, wherein the first set of fixing means as well as the second set of fixing means are or can be without holes, whereby it is possible e.g. by self-tapping screws as fixing unit to fasten facing elements to the rail without the rail having distributed holes.

In an embodiment of a rail system for mounting facing elements according to the invention, an elongated rail may include at least one of the following sets of fixing means, wherein the fixing means are arranged longitudinally of the rail:

- a series of uniform and evenly distributed holes for receiving a first type of fixing units, e.g. screws, wherein the holes are disposed in at least one row in longitudinal direction of the rail;
- a series of evenly distributed cutouts equidistantly spaced in longitudinal direction of the rail for receiving a second type of fixing units, e.g. spring clips;
- at least one longitudinal slot, wherein the slot or slots are arranged on the body part in longitudinal direction of the rail and adapted for receiving at least one hook part of a joining rail.

The holes with uniform spacing may advantageously be in magnitude of 2, 3 or 4 mm in diameter, or they may have non-circular shape but with corresponding area and thereby be suited for interacting with a self-tapping screw, each screw constituting a fixing unit, and wherein a facing element is fixed at its upper edge by one, two, three or more of such screws. A fixing unit can also be a metal or plastic clip that is passed through a hole or cutout in the facing element itself and then pressed into one of the mentioned holes.

In a preferred embodiment, the facing elements can be provided with an elongated hole extending in the same direction as the rail, meaning that there will always be one hole, preferably two holes accessible through the elongated hole. By such a solution for fixing facing elements, these are held at their upper edge onto the contact face on the body part of the rail, and the used fixing units are covered by the subsequent row of facing elements, something which will appear from Figures and the detailed explanation below.

Another variant of a rail system according to the invention includes that a facing element is fixed via one or more spring clips disposed in evenly spaced cutouts in longitudinal direction of the rail and on the body part. In a preferred embodiment, these cutouts for spring clips are located above the said row of holes such that the actual spring clips can be supported in these holes while at the same time holding a facing element against the body part at its upper edge. A spring clip can thus be designed with a rear leg that is passed through the cutout and further supported by a complete or partial engagement with a hole in the said row of holes. At the same time, these spring clips also include a hook part adapted to support the subsequent row of facing elements at their lower edge. This will also appear more clearly from the detailed description and the drawing.

A rail system for mounting facing elements according to the invention may include that a fixing unit in the form of a spring clip includes a front leg and a rear leg, the rear leg adapted with means for engaging one or more holes, slits or cutouts in the rail, the front leg adapted with means for fixing a first facing element against the body part of the rail, the fixing occurring at the upper edge of the first facing element, the front leg further including means for supporting a second facing element at its lower edge, the second facing element being held directly or indirectly against an area along the upper edge of the first facing element.

By such a solution is achieved the advantage that the fixing units, here spring clips, are kept in position by the cutout or the hole through which they are passed, though that they also are supported in that the rear leg is passed through a hole, a cutout or a slit in the rail where the hole/cutout/slit is disposed under the cutout mentioned at first. By the just mentioned solution it is so that the rear leg of the fixing element is directly or entirely in engagement with e.g. a hole in the said row of holes.

In another variant, the fixing units can be adapted such that the rear leg is only supported in e.g. a hole in the said row of holes. That the rear leg on a clip is supported in a hole means that the rear leg is not passed completely through the hole, but only bears on the hole. This will appear from the subsequent Figures.

In yet a variant of a rail system for mounting facing elements according to the invention, the fixing unit in the form of the spring clip may include a rear leg having a length and a shape which, when the spring clip is fitted in a rail, allow the rear leg to protrude through an opening, an cutout or a slit in the rail, and in contact with the rear side of a first facing element.

This variant of a spring clip can be with slightly outward facing end of the rear leg, thought it may be with both an outwards and an inwards facing end that will slide in position more easily. Irrespectively if the rear leg has one or the other shape, the new and surprising effect is that the fixing unit—here a spring clip—exerts a spring force against the back side of the facing element and that a better fixing of the facing element to the rail is thus provided, something which has not been possible to achieve by the prior art solutions. A further result thereof is that the risk of the facing elements clattering in windy weather is strongly reduced.

Such a rail can be with holes and with cutouts over the holes as mentioned above and as shown in the Figures below, providing the possibility that fixing units/spring clips can be seated in cutouts and supported in holes actually being a different type of fixing means. Another possibility is that a rail can be with cutouts between or over the said holes and with a combined drain hole and support hole under the said holes. Hereby is achieved the possibility that a fixing unit/spring clip can be placed in a cutout and supported in a drain hole and that the spring clip possibly can bear against the back side of a facing element as already mentioned.

A rail system for mounting facing elements according to the invention may further include a fixing unit in the form of a joining rail that includes a U-shaped rail part, the rail part including means for fixing at least one facing element at the upper edge of facing element.

The means of the rail part can be U-shaped with two flanges, each extending a length down of front side and back side, respectively, of one or more facing elements that are mounted in the joining rail. For example, the joining rail can include means for securing at least one facing element but preferably for securing several adjacent and juxtaposed facing elements. The facing elements may thus be sorted and mounted in a joining rail before suspension/mounting in a rail system on a façade. For example, five or six facing elements can be arranged in a joining rail and mounted at once.

A solution with a joining rail can be used right away on e.g. a façade provided with wooden fillets or lathes, another type of rail or at fixing points where respective facing elements are fixed in a joining rail, and where the joining rail subsequently is fixed to the fillet/lath/rail/fixing points. This can be effected by nails, screws or other suitable fixing method, and such a joining rail may furthermore be designed with a hook part as described below. In other words, it is not important if mounting is performed in one or the other way as it is the application of a joining rail which is essential.

A rail system for mounting facing elements according to the invention may advantageously include that a fixing unit in the form of a joining rail includes a rail part and a hook part, the hook part adapted with means for engaging one or more holes, slits, edges, slots or cutouts in the rail, the rail part including means for arranging at least one facing element at the upper edge of facing element.

A hook part of a joining rail can also be constituted by a support flange or a number of support flanges extending from the rail part and in over a fillet, a lath or in over a rail or a fixing point at mentioned above. Thus there is no need for one or more actual hook parts that are hooked on a rail, but only that a support flange or surface is resting upon a top side of a fillet, lath, rail or similar, constituting a sufficient support for the composite facing element. However, in such a case it is to be expected that additional fixing units are to be applied, such as screws, nails, clips, glue or other means that ensure sufficient retention of the facing elements.

A joining rail may therefore be designed with or without a hook part, but in case of the presence of a hook part or a support flange it is easy to suspend a joining rail with associated facing elements on a fillet/rail and then fix either the joining rail or support flange, or alternatively fix the individual facing elements to the rail. By this solution is achieved the option of arranging facing elements in relation to each other, and thereby possibility of allowing for a possible pattern or colour differences of the respective individual facing elements.

A variant of a rail system according to the invention may include the establishment of a longitudinal slot in the body part of the rail, e.g. at the upper edge thereof between an inner façade or as a long slit in the body part of the rail itself. Spring clips or other types of fixing units can be used in the slot, though in particular the said joining means with hook part, something which will appear from the drawings and descriptions below.

In a variant of a rail system for mounting facing elements according to the invention, a joining rail at the outer side of the rail part may include an elastic cover for contact with the back side of overlying facing elements. The elastic cover may e.g. be a rubber band or other suitable material which, when the facing has been mounted, prevents noise from facing elements slightly clattering in the wind, a kind of clatter safeguard. It may also be an adhesive elastic cover that practically keeps respective facing elements in place in mutual position.

Yet a variant of a clatter safeguard can be constituted by one, two or more narrow longitudinal lips at the outer side of the rail part where the lips are resilient, either by the material being compressible or alternatively by being deformable and flexing by the action of the facing elements bearing on the lip or lips. An example will appear from the drawing below.

A joining rail as mentioned above can also be designed such that either there is arranged an internal glue run in the U-shaped rail part or such that immediately before arranging facing elements in the rail part a run of glue is applied internally of the rail part. Hereby the facing elements are secured to the rail part, providing a more secure suspension and in some cases also a more rapid and thereby less costly facing.

In yet a variant of a rail system for mounting facing elements according to the invention, the joining rail on the U-shaped rail part may include at least one elastic flange, where at least one of the two flanges of the U-shaped rail part includes securing means for engaging the surface of a facing element.

A joining rail thus has at least one elastic flange allowing a kind of click-assembly with one or more facing elements whereby engagement between the joining rail and the facing element is created. It may e.g. be a depression at one or both sides of the facing elements where these joining rails are provided on the flanges with corresponding projections that are brought in contact with the depressions. By such a variant there may furthermore be a glue run internally of the rail part as well, providing extra fixation of the individual facing elements in the joining rail.

A rail system for mounting facing elements according to the invention can be designed such that a rail on its body part includes a longitudinal depression, the depression being arranged for receiving a longitudinal inner part of a joining rail. Hereby is achieved the possibility that it is not one flange of the joining rail but the back side of the facing elements that is brought in contact with the body part on the rails.

A joining rail as indicated above can also be made as a corner model. By a corner model it is possible to arrange e.g. two facing elements adapted such that they form a corner with a given included angle or an external angle as these facing elements are adapted to each other so that they can be mounted either in an inside corner or on an external corner. The joining rail can be made in right as well as left models, and therefor also for inside as well as external corners.

Finally, it is to be mentioned that a rail system for mounting facing elements according to the invention may include that a fixing unit in the form of spring clips are made of metal wire, e.g. a resilient steel wire. Clips and other fixing units may, however, also be made of other materials, including plastic and composite materials such as a metal-plastic combination, alternatively of fibre-reinforced plastic composites.

DESCRIPTION OF THE DRAWING

The invention is described in the following with reference to the drawing, wherein.

In the explanation of the Figures, identical or corresponding elements will be provided with the same designations in different Figures. Therefore, an explanation of all details will not necessarily be given in connection with each single Figure/embodiment.

LIST OF DESIGNATIONS

Figure 1:
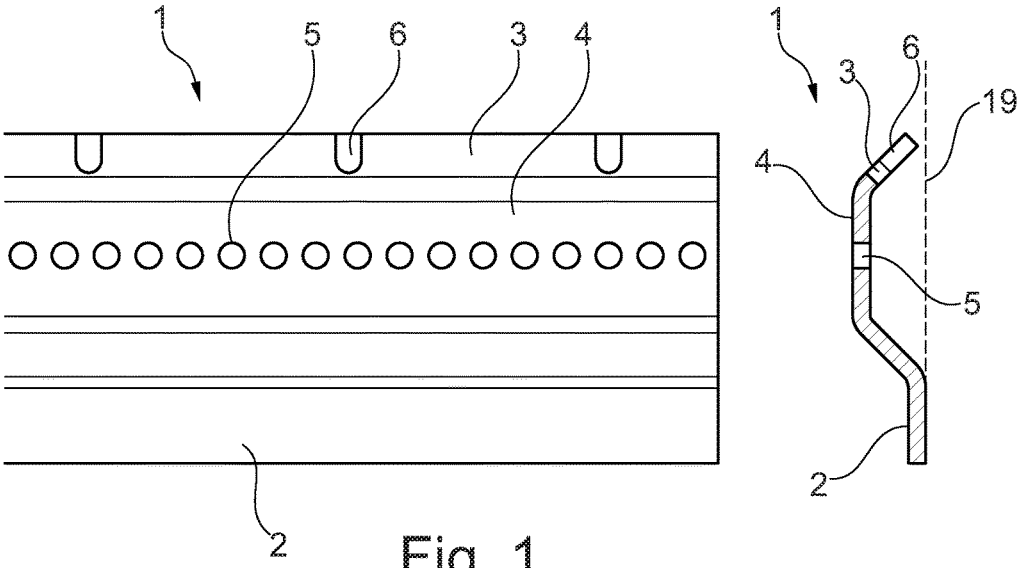
FIG. 1 shows a rail with two sets of fixing means in a front view and an end view, respectively.

1 rail
2 means for mounting on facade/flange member
3 body part
4 contact surface
5 first set of fixing means
6 second set of fixing means
7 facing element
8 back side of facing element
9 front side of facing element
10 lower edge of facing element
11 upper edge of facing element
12 fixing unit
13 spring clip
14 front leg
15 rear leg
16 cutout
17 bend on rear leg
18 hole
19 building structure
20 screw
21 joining rail
22 hook part
23 rail part
24 flange on rail part
25 securing means on flange
26 depression in surface of facing element
27 elongated hole in facing element
28 elastic cover/clatter safeguard
29 longitudinal depression on rail
30 glue in rail part
31 barbs/lips
32 thin lip
33 corner joining rail
34 right leg
35 left leg
36 third set of fixing means
37 rabbet at upper edge of body part

DETAILED DESCRIPTION OF EMBODIMENTS OF THE INVENTION

In FIG. 1 appears a rail 1 with means 2, here in the form of a flange member 2, for mounting on a façade and with a body part 3 having a contact face 4 for the back side 8 of a not shown facing element. The rail 1 has a first set of fixing means 5 on the contact face 4 and at the upper edge of the body part a second set of fixing means 6.

The rail 1 appears in a front view as well as an end view. The rail 1 can be fixed to a façade or a building structure directly or indirectly by means of fittings, nails, screws or other suitable methods.

As seen on the Figure, the body part 3 has inclining surfaces at the sides, enabling a closer stacking when the product is stored and during transport. Such a rail 1 may advantageously be made of aluminium or steel or other metal, and it may be shaped by bending and/or rolling from a rolling material. A rail 1 may, however, also be extruded in e.g. aluminium or other suitable material. It can be pultruded in fibre composite or be moulded in moulds suited for the purpose.

Figure 2:
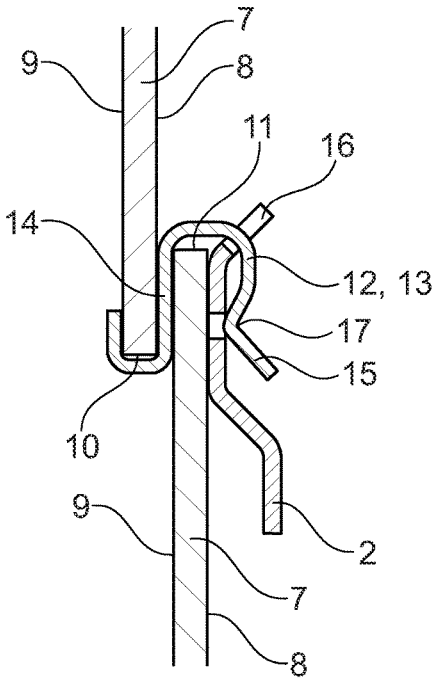
FIG. 2 shows a rail as shown in FIG. 1 in an end view but with two facing elements and with a fixing unit in the form of a clip.

FIG. 2 also shows a rail 1 in an end view as shown in FIG. 1, but here with two facing elements 7. Facing elements 7 each have a back side 8, a front side 9, a lower edge 10 and an upper edge 11. The facing elements 7 are seen kept in place by a fixing unit 12 in the form of a spring clip 13. It appears that the lower facing element 7 is held against the contact face 4 at the upper edge 11 by the front legs 14 of the clip that also support the lower edge 10 of the facing element 7 in the next row. Furthermore it appears that the rear leg 15 of the clip is passed through a cutout 16 in the second set of fixing means 6, and that the rear leg 15 is made with a bend 17 supported in a hole 18 in the first set of fixing means 5. It also appears that the contact face 4 is offset in relation to the flange member 2 whereby space is provided for placing the spring clip 13.

Figure 3:
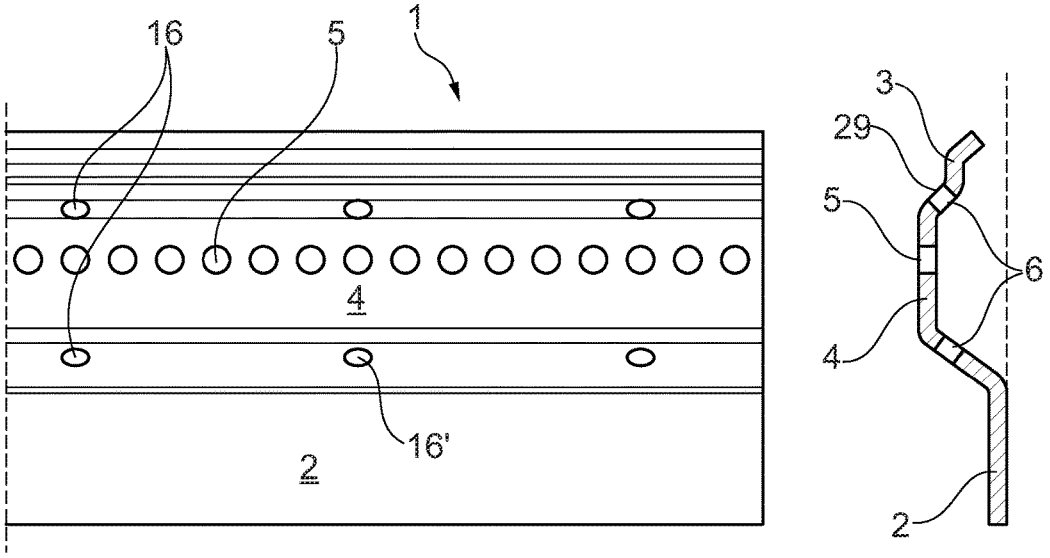
FIG. 3 shows a rail with two sets of fixing means in a front view and an end view, respectively.

FIG. 3 shows a rail 1 with two sets of fixing means 5, 6 as seen in a front view and an end view, the second set of fixing means including an upper cutout 16 and a lower cutout 16', the lower cutout 16' acting as a drain hole for possible water behind the façade but also as a support for the rear leg of a spring clip 13 or another type of fixing unit 12.

Figure 4:
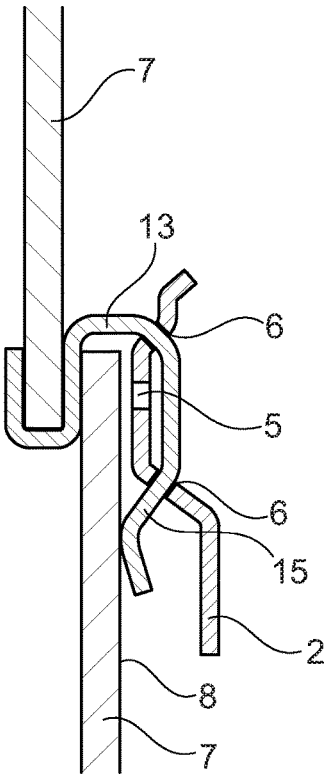
FIG. 4 shows a rail as shown in FIG. 3 in an end view but with two facing elements and with a fixing unit in the form of a clip.

FIG. 4 shows a rail 1 as shown in FIG. 3 in an end view but with two facing elements 7 and with a fixing unit 12 in the form of a spring clip 13. The spring clip 13 is here designed with a rear leg 15 that has a shape allowing its being passed through the lower cutout 16', and that the rear leg 15 at the same time is brought in contact with the back side 8 on the actual facing element 7. Hereby is achieved a good support and a very firm grip on the upper edge 11 of the facing element. The rear leg 15 is here designed such that the end is partly directed away from the back side 8 of the facing element.

Figure 5:
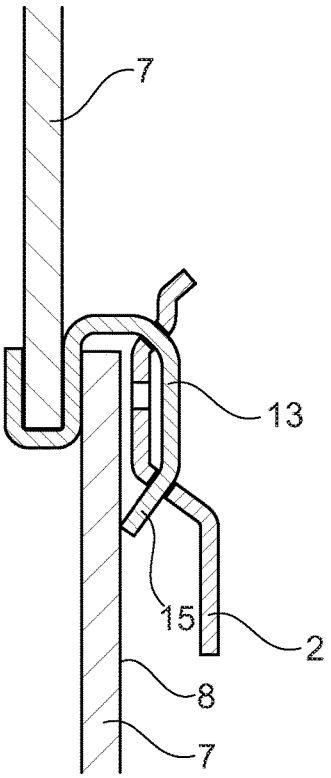
FIG. 5 shows a rail as shown in FIG. 3 in an end view but with two facing elements and with a fixing unit in the form of a clip.

FIG. 5 shows a rail 1 as shown in FIG. 3 in an end view but with two facing elements 7 and with a fixing unit 12 in the form of a spring clip 13. The spring clip 13 is here designed with a rear leg 15 that has a shape allowing its being passed through the lower cutout 16', and that the rear leg 15 at the same time is brought in contact with the back side 8 on the actual facing element 7. Hereby is achieved good support and a very firm grip at the upper edge 11 of the facing element. The rear leg 15 is here designed such that the end is partly directed towards the back side 8 of the facing element.

Figure 6:
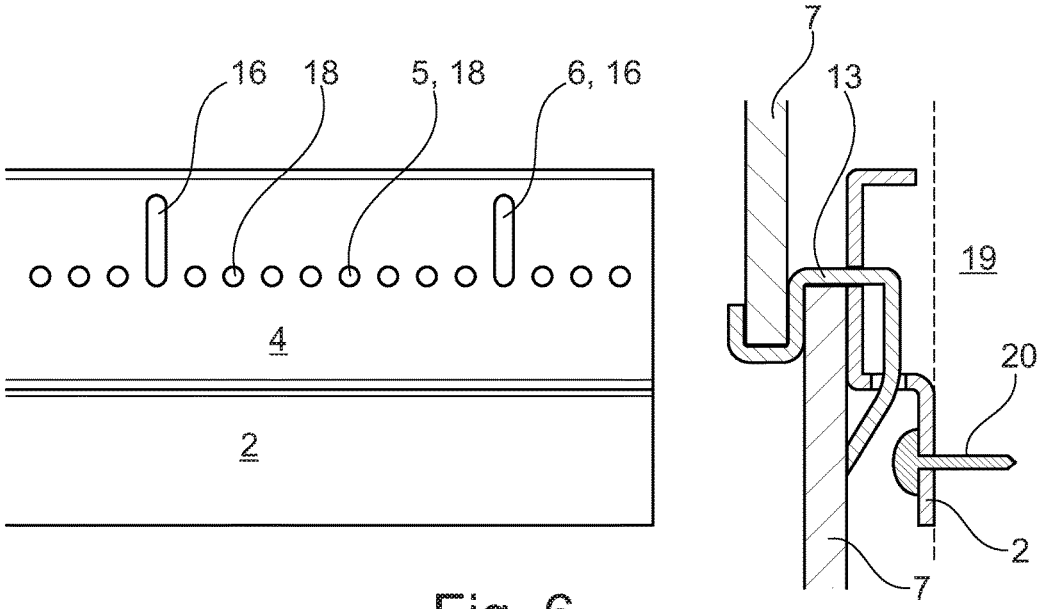
FIG. 6 shows a rail with two sets of fixing means in a front view and an end view, respectively.

FIG. 6 shows a rail 1 with two sets of fixing means 5, 6 in a front view and an end view, respectively. By this variant there is a long row of holes 18 that are regularly broken by elongated cutouts 16, and below these cutouts at the lower edge of the body part cutouts 16' are arranged, acting as drain holes for possible water behind the façade but also as support for the rear leg of a spring clip 13 or another type of fixing unit 12. In this Figure, the rail 1 appears fixed at its flange member 2 to a building structure 19 by a screw 20.

Figure 7:
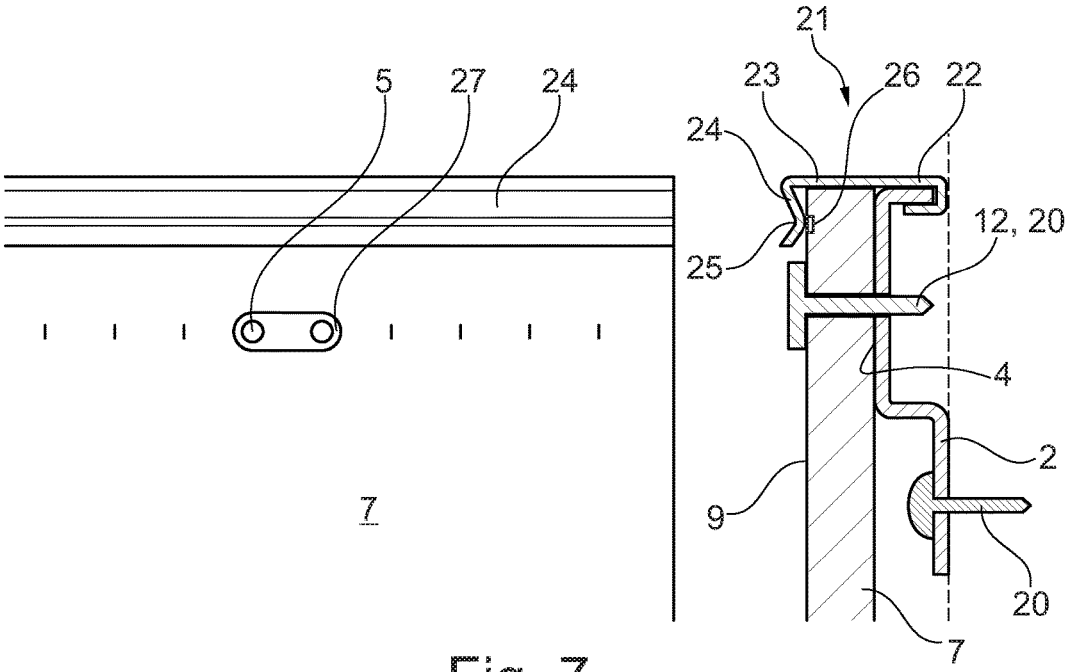
FIG. 7 shows a rail with facing element in a front view and an end view and with a fixing unit in the form of a joining rail with hook part.

FIG. 7 shows a rail 1 with facing elements 7 in a front view and an end view, and with a fixing unit 12 in the form of a joining rail 21 with a hook part 22 and with a rail part 23. The joining rail 21 is here mounted at the upper edge of the body part 3 in a slit, slot or in a number of cutouts, and is intended for mounting without facing elements 7 as the latter are pushed up into the rail part 23 and fixed therein by the joining rail 21 provided with a flange 24 with securing means 25 that interact with a longitudinal depression 26 in the front side of the facing element 9.

In this variant, the rail part 23 is formed by the flange 24 and by the contact face 4 on the body part 3. After mounting the facing elements in the joining rail 21, they may advantageously be fixed to the rail 1 by fixing units 12 in the form of clips or screws 20 that are placed in the first set of fixing means 5. In FIG. 7 is also seen that the facing elements 7 have a horizontal, elongated hole 27 at the upper edge 11 through which it will always be possible to target a hole 18 in the contact face 4, something which is ensured by the size of the elongated hole 27.

Figure 8:
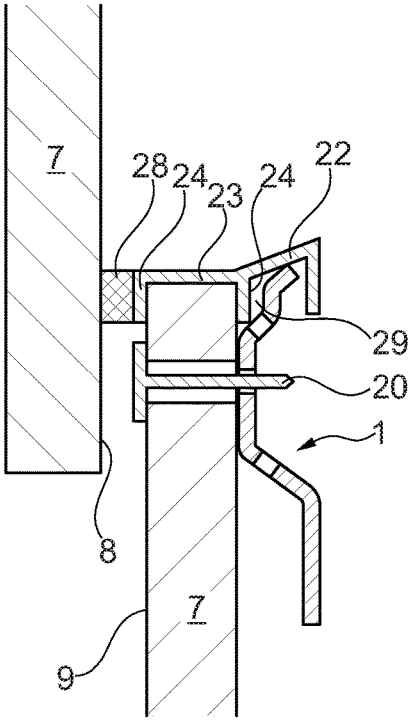
FIG. 8 shows a rail in an end view with two facing elements and with a fixing unit in the form of a joining rail with mounting bands and with hook part, and with an additional fixing unit in the form of a screw.

FIG. 8 shows a rail 1 in an end view with two facing elements 7 and with a fixing unit 12 in the form of a joining rail 21 with an elastic cover 28, herein the form of a rubber band, with a hook part 22 and with an additional fixing unit 12 in the form of a screw 20 pressing individual facing elements against the body part 3 of the rail. The elastic cover 28 may, as mentioned, be constituted by rubber band or other elastic material, which e.g. can be an adhesive material of suitable type.

The rails 1 appearing in FIGS. 8 to 14 are all the same as the rail 1 appearing in FIG. 3 to FIG. 5, and it has a longitudinal depression 29. The depression 29 provides space for a joining rail 21 at the upper edge 11 of the facing elements without the internal flange 24 of the joining rail on the rail part 23 being in contact with the contact face 4 on the body part 3.

Figure 13:
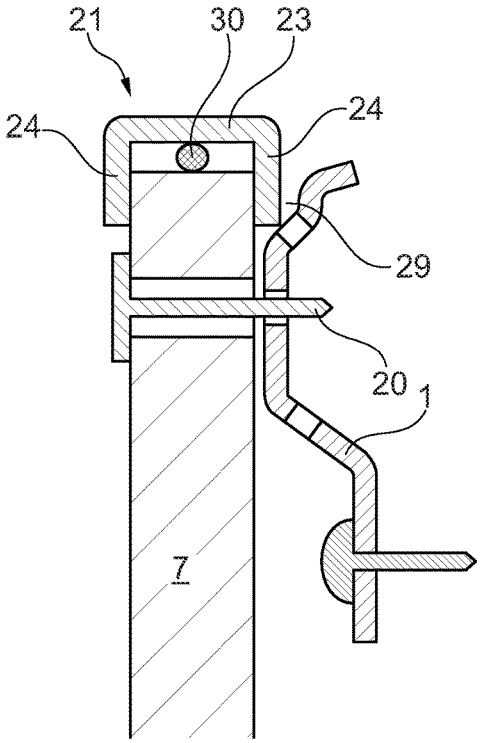
FIG. 13 shows a rail in an end view and with one facing element, with fixing units in the form of a joining rail without hook part and in the form of a screw.
Figure 14:
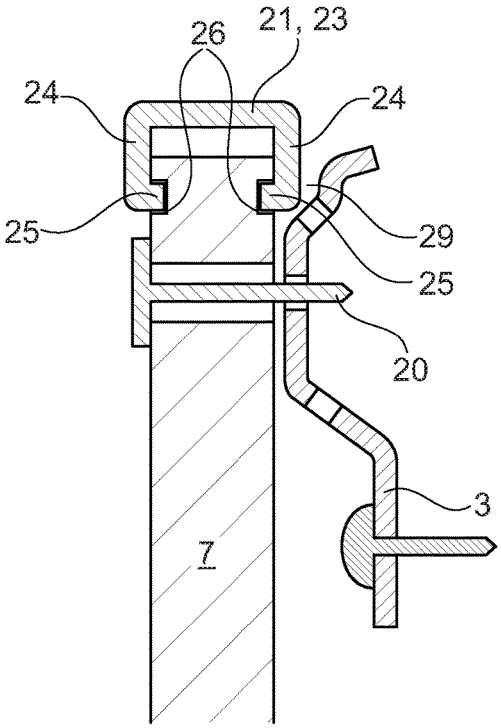
FIG. 14 shows a rail in an end view and with one facing element, with fixing units in the form of a joining rail without hook part but with elastic flanges, and in the form of a screw.

In FIGS. 8, 13 and 14 there are examples of joining rails 21 that are not in direct contact with the body part 3.

Figure 9:
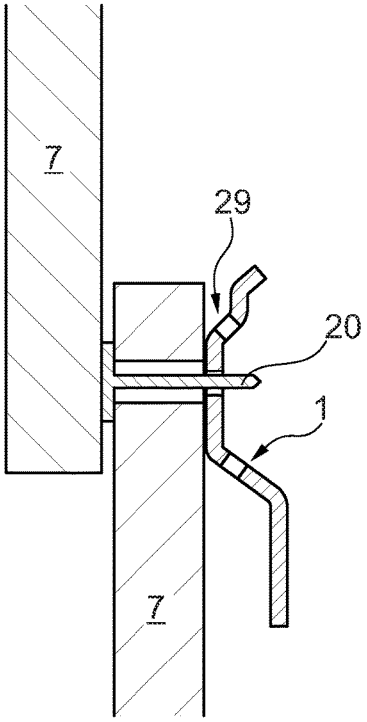
FIG. 9 shows a rail in an end view and with two facing elements and with a fixing unit in the form of a screw.

FIG. 9 shows a rail 1 in an end view and with two facing elements 7 and with a fixing unit 12 in the form of a screw 20. In principle this is the simplest form of mounting facing elements with a rail system according to the invention.

Figure 10:
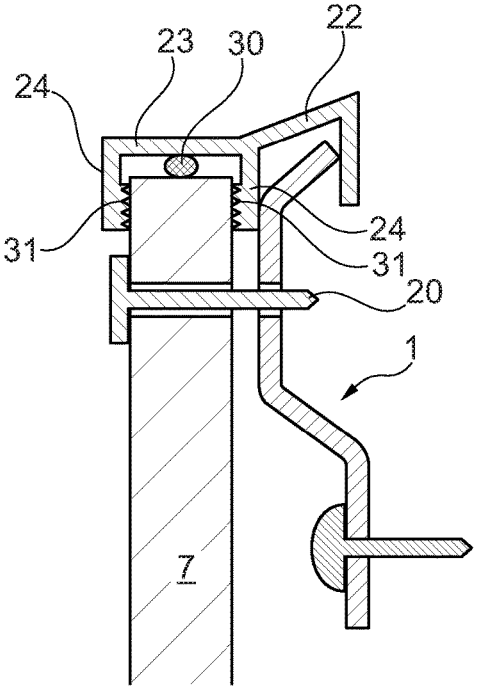
FIG. 10 shows a rail in an end view and with a facing element, with fixing units in the form of a joining rail with rail part and hook part and with a screw.

In FIG. 10 appears a joining rail 21 which is pressed down over a number of facing elements 7 and which via a hook part 22 is mounted on the rail at its upper edge, either in a slit, a slot or in a number of cutouts. The facing element 7 is further fixed to the rail 1 by a screw 20. In this variant, the joining rail 21 is provided with glue 30 in the rail part 23 such that the facing elements 7 and the joining rail 21 are securely joined. Besides, a kind of barbs/lips 31 are arranged on the two flanges 24 on the rail part 23, ensuring an even better joining.

Figure 11:
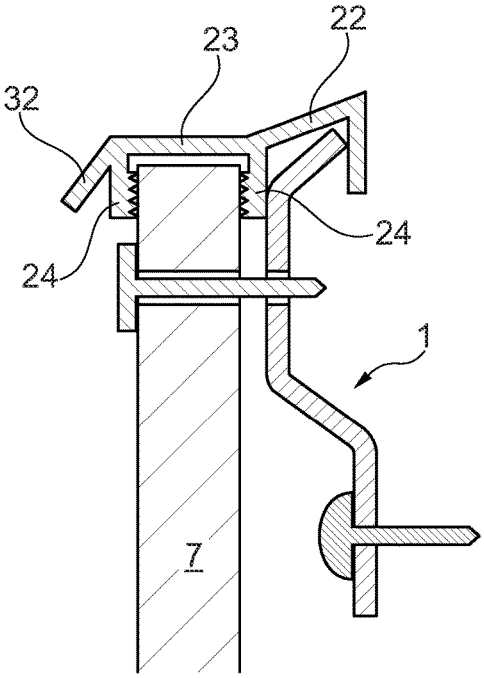
FIG. 11 shows a rail in an end view and with a facing element, with fixing units in the form of a joining rail with rail part and hook part and with a screw.

In FIG. 11 appears a joining rail 21 which is pressed down over a number of facing elements 7 and which via a hook part 22 is mounted on the rail at its upper edge, either in a slit, a slot or in a number of cutouts. The facing element 7 is further fixed to the rail 1 by a screw 20. In this variant, the joining rail 21 is also designed with barbs/lips 31 on the two flanges 24 on the rail part 23, ensuring good joining. On this joining rail 21 is additionally formed an elastic cover 28, a clatter safeguard, here consisting of one longitudinal thin lip 32 where the back side 8 of a not shown facing element 7 is intended to bear on the thin lip 32. Obviously, such thin lips 32 with other shapes than shown here may be provided, and there may be more than one of these lips 32 along a joining rail 21. In the shown variant, the thin lip is arranged on a flange 24 on the rail part 23, but it may e.g. be arranged at the back of the rail part 23 as well.

The joining rails 21 can be made of metal, plastic or fibre composite, or of any other suitable material. They may be moulded, extruded, pultruded, bent or rolled.

Figure 12:
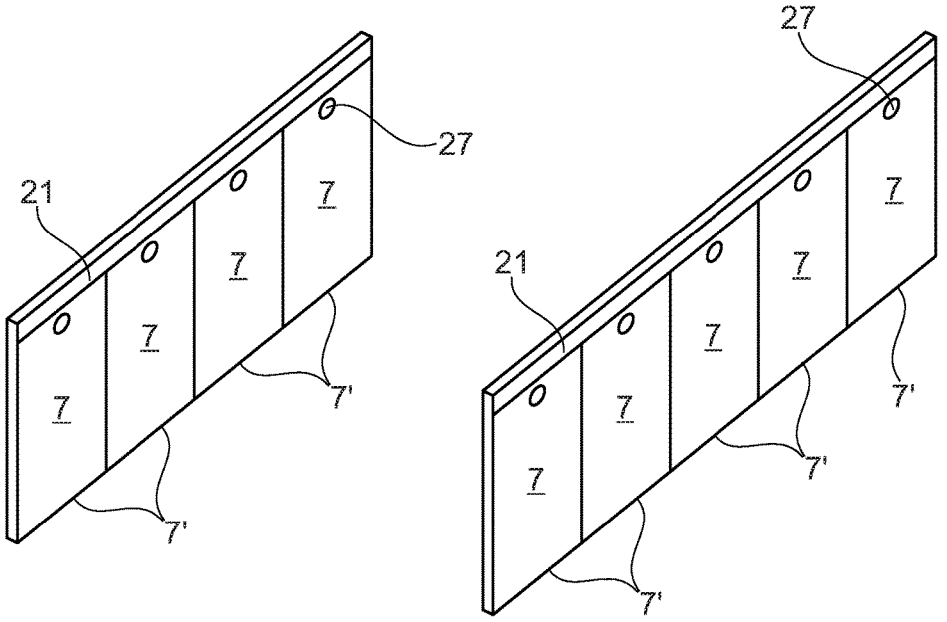
FIG. 12 shows a facing element with four and one with five facing elements that are both joined into one facing element via a joining rail.

FIG. 12 shows two joined facing elements 7' consisting of four and of five, respectively, juxtaposed and adjacent facing elements 7, which via a joining rail 21 are joined into one facing element 7' that can be suspended on a rail 1 if the joining rail 21 includes a hook part 22. If the joining rail 21 has a hook part 22, the assembled facing element can e.g. be mounted by one or more fixing units 12, e.g. screws 20 or a suitable type of clips.

In FIG. 13 appears a rail 1 in an end view and with one facing element 7, with fixing units 12 in the form of a joining rail 21 without hook part 22 and in the form of a screw 20. The joining rail 21 is here without a hook part 22 and therefore only comprises a rail part 23 with two flanges 24, where in the rail part 23 there is arranged a glue run 30 for fastening the individual facing elements.

In FIG. 14 appears a rail 1 in an end view and with one facing element 7, with fixing units 12 in the form of a joining rail 21 without hook part 22, but with elastic flanges 24, and in the form of a screw 20. The elastic flanges 24 are provided with securing means 25 which, when a facing element 7 is pressed into the joining rail 21, is forced aside for then dropping in place in the depressions 26 arranged for the purpose in the surfaces 8, 9 of the facing elements 7.

Figure 15:
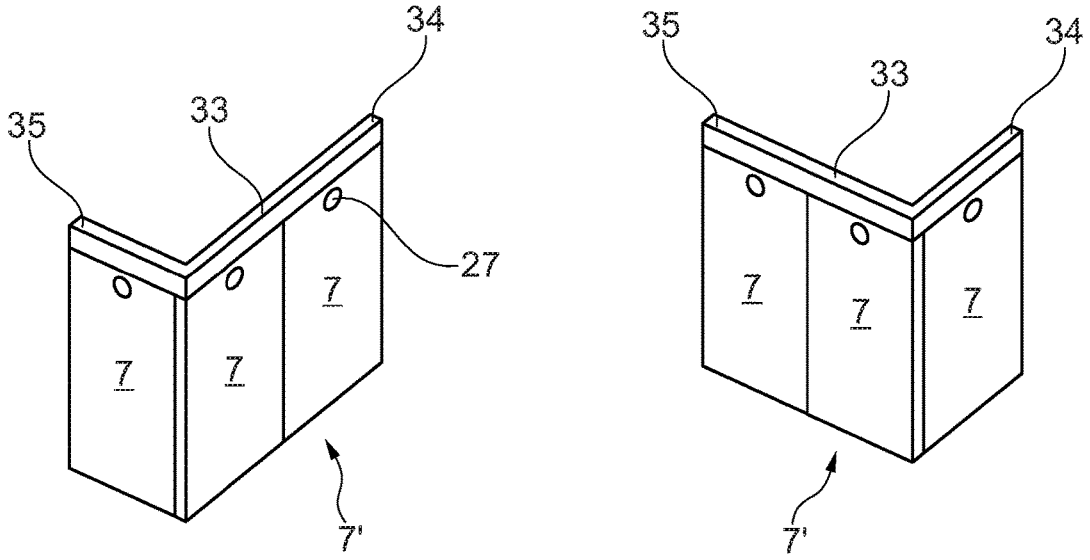
FIG. 15 shows a right and a left corner joining rail, each fitted on three facing elements.

FIG. 15 shows a right and a left corner joining rail 33, each fitted on three facing elements. The right model has two facing elements 7 mounted in the right leg 34 and one facing element 7 in the left leg 35. The left model is arranged reversed. However, such corner joining rails 33 can obviously be made adapted for mounting only on one facing element at each leg 34, 35, or on more than two facing elements 7, if so desired.

Figure 16:
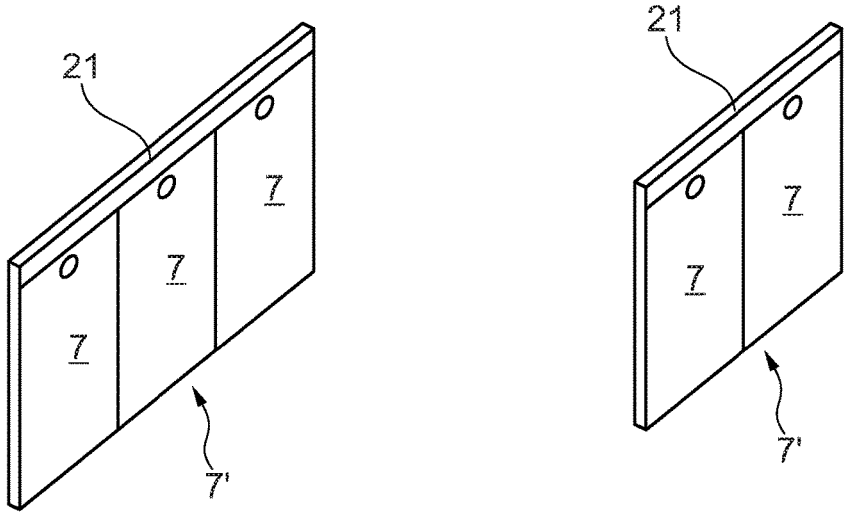
FIG. 16 shows a facing element with three and one with two facing elements that are both joined into one facing element via a joining rail.

FIG. 16 shows a composed facing element 7' with three facing elements 7 and one with two facing elements 7, both joined into one facing element 7' via a joining rail 21.

Figure 17:
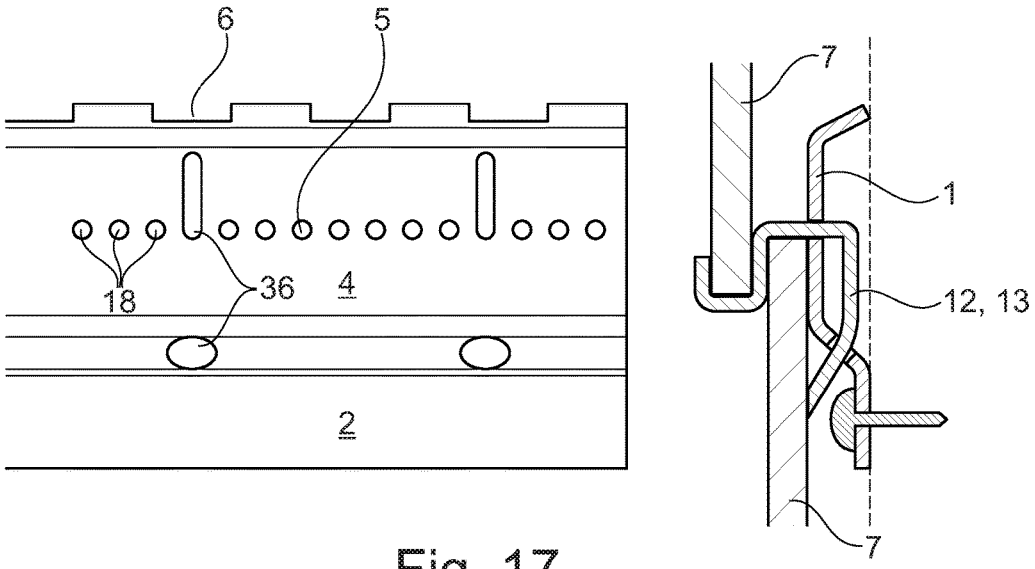
FIG. 17 shows a variant of a rail with three sets of fixing means in a front view and an end view, respectively.

FIG. 17 shows a variant of a rail 1 with three sets of fixing means 5, 6, 36 in a front view and an end view, respectively. The rail 1 has a first set of fixing means 5 on the contact face 4, at the upper edge of the body part a second set of fixing means 6, and evenly distributed between the first fixing means is disposed is a third set of fixing means 36. The means 36 are also disposed evenly but with greater spacing than the holes 18. The rail 1 appears in a front view as well as an end view. The rail 1 can be fixed to a façade or a building structure directly or indirectly by means of fittings, nails, screws or other suitable methods.

Figure 18:
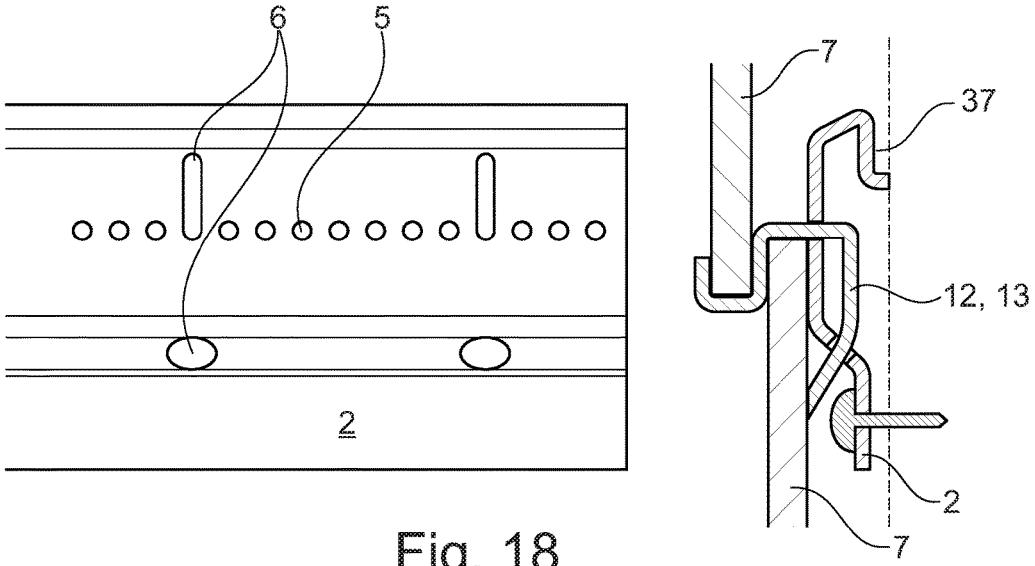
FIG. 18 shows a variant of a rail with two sets of fixing means in a front view and in an end view where the rail is supported on the building structure located behind it.

FIG. 18 shows yet a variant of a rail 1 with two sets of fixing means 5, 6 in a front view and an end view, respectively, where the rail 1 is supported on the building structure 19 located behind it. At the upper edge of the body part 3 there is arranged a kind of rabbet 37 with the purpose of the rail being supported on the said building structure 19 via this rabbet, and such that a greater pressure can be applied on the rail 1 itself during mounting of the facing elements 7, so that the rail 1 is not deformed or yields resiliently.

The invention claimed is:

1. A rail system for mounting facing elements on a façade, wherein the rail system includes:

an elongated rail with a longitudinal direction, the rail system further including an elongated joining rail having an U-shaped profile and including means for mounting on an upper edge of a facing element of a façade, said means including a rail part having a first downwardly depending flange projecting from a rear end of the rail part and defining a first leg of the U-shaped profile and a second downwardly depending flange projecting from the rail part and spaced a distance from the first downwardly depending flange greater than a thickness of the upper edge of the facing element of the façade to which the joining rail is to be mounted, the second depending leg defining a second leg of the U-shaped profile, a terminal end the elongated rail securely received in a portion of the joining rail that projects prominently of the second depending leg of the joining rail, the rail system further including means comprising a screw for further fixing facing elements to the elongated rail, and wherein the rail system further includes at least one fixing unit for at least one facing element, the means for direct or indirect mounting on a façade constituted by at least one flange member, the flange member extending in a first plane, and wherein the means for fixing facing elements to the rail includes a body part with a contact face for a back side of a facing element, the contact face extending in a second plane, wherein the first and second planes are mutually offset, the body part including at least a first set of fixing means.

2. The rail system for mounting facing elements according to claim 1, wherein the elongated rail includes at least one of the following sets of fixing means, the fixing means arranged longitudinally of the rail:

a series of uniform and evenly distributed holes for receiving a first type of fixing units, wherein the holes are disposed in at least one row in longitudinal direction of the rail;

a series of evenly distributed cutouts equidistantly spaced in longitudinal direction of the rail for receiving a second type of fixing units;

at least one longitudinal slot, wherein each of the at least one longitudinal slots is arranged on the body part in longitudinal direction of the rail and adapted for receiving at least one hook part of a joining rail.

3. The rail system for mounting facing elements according to claim 1, wherein a fixing unit in the form of a spring clip includes a front leg and a rear leg, the rear leg adapted with means for engaging one or more holes, slits or cutouts in the rail, the front leg adapted with means for fixing a first facing element against the body part of the rail, the fixing occurring at the upper edge of the first facing element, the front leg further including means for supporting a second facing element at its lower edge, the second facing element being held directly or indirectly against an area along the upper edge of the first facing element.

4. The rail system for mounting facing elements according to claim 3, wherein the fixing unit in the form of the spring clip includes a rear leg having a length and a shape which, when the spring clip is fitted in a rail, allow the rear leg to protrude through an opening, an cutout or a slit in the rail, and in contact with the rear side of a first facing element.

5. The rail system for mounting facing elements according to claim 1, wherein the joining rail includes a hook part extending from the rail part prominently of the second downwardly depending leg.

6. The rail system for mounting facing elements according to claim 1, wherein the joining rail at the outer side of the rail part includes an elastic coating on a surface of the first downwardly depending leg for contact with the back side of overlying facing elements.

7. The rail system for mounting facing elements according to claim 1, wherein the joining rail on the U-shaped rail part includes two elastic flanges, where each of the two flanges of the U-shaped rail part includes securing means for engaging the surface of a facing element.

8. The rail system for mounting facing elements according to claim 1, wherein the elongated rail includes a longitudinal depression on its body part.

9. The rail system for mounting facing elements according to claim 1, wherein fixing unit in the form of a spring clip is made of metal wire.

10. The rail system for mounting facing elements according to claim 9, the metal wire being a resilient spring wire.

11. The rail system for mounting facing elements according to claim 1, each of the first and second downwardly depending legs having a plurality of barbs on a surface thereof facing the opposite one of the second and first downwardly depending legs.

12. The rail system for mounting facing elements according to claim 1, further comprising glue on a surface of the joining rail exposed to the upper edge of the facing element to which the joining rail is to be mounted.

* * * * *